United States Patent [19]

Gillberg-LaFore et al.

[11] Patent Number: 4,859,350

[45] Date of Patent: Aug. 22, 1989

[54] VISCOSITY REGULATORS FOR WATER-BASED SPIN FINISHES

[75] Inventors: Gunilla E. Gillberg-LaFore, Summit; Helen A. Kravas, Chatham, both of N.J.

[73] Assignee: Hoechst Celanese Corp., Somerville, N.J.

[21] Appl. No.: 244,650

[22] Filed: Sep. 13, 1988

Related U.S. Application Data

[63] Continuation of Ser. No. 859,972, May 5, 1986, abandoned.

[51] Int. Cl.[4] ..... D06M 13/18; C10M 173/00

[52] U.S. Cl. ..... 252/8.9; 252/8.6; 252/49.5

[58] Field of Search ..... 252/8.9, 49.5; 524/612

[56] References Cited

U.S. PATENT DOCUMENTS

| | | | |
|---|---|---|---|
| 3,393,157 | 7/1968 | Janssen et al. | 528/242 |
| 3,850,682 | 11/1974 | Sturwold et al. | 252/49.5 |
| 3,925,589 | 12/1975 | Sturwold et al. | 252/49.5 |
| 4,304,902 | 12/1981 | Landoll | 528/419 |
| 4,312,768 | 1/1982 | Nassry et al. | 252/49.5 |
| 4,415,701 | 11/1983 | Bauer | 524/612 |
| 4,502,968 | 3/1985 | Noda et al. | 252/8.8 |
| 4,561,987 | 12/1985 | Yamamoto et al. | 252/8.9 |
| 4,622,038 | 11/1986 | Login et al. | 252/8.9 |

*Primary Examiner*—William R. Dixon, Jr.
*Assistant Examiner*—Ellen M. McAvoy
*Attorney, Agent, or Firm*—Burns, Doane, Swecker & Mathis

[57] ABSTRACT

A spin finish composition is disclosed which contains an associative thickener which does not significantly affect the initial viscosity of the spin finish composition but which causes a substantial increase in viscosity as water contained therein decreases from its initial level to about 70%, and which effects no substantial change in viscosity of the composition as the water contained therein decreases from 40 to 0%. By virtue of this behavior, a spin finish composition results which can be improved in terms of spreadability on the yarns, package build, spin line coherence, the number of broken filaments and the tackiness of the snow formed on the texturings disks. Additionally, variations in the evnironment in which spin finish is applied e.g., temperature and humidity, do not substsantially affect its performance.

19 Claims, 11 Drawing Sheets

VISCOSITY REGULATORS FOR WATER-BASED SPIN FINISHES

This application is a continuation of application Ser. No. 859,972 filed May 5, 1986, now abandoned.

BACKGROUND OF THE INVENTION

1. Field of the Invention

The present invention relates to finish compositions for yarns and more particularly, to associative thickeners which enable the viscosity of the composition to be controlled as a function of the water content.

2. Description of the Prior Art

Spin finishes and process finishes are compositions normally employed in the fiber industry for lubrication of filaments or yarns during textile operations i.e., during the melt spinning, drawing, weaving or knitting or otherwise fabricating individual filaments or staple fibers into various textile articles. In addition to the essential lubricating agent and its solvent or emulsifying liquid, such as water, small amounts of other modifying agents may also be present. Generally, finishes comprise a lubricating oil, an antistatic agent, and an emulsifier.

The spin and process finish compositions are generally applied as dilute aqueous solutions having an oil base content by weight in the range of 1 to 30% and preferably 8 to 15%. The viscosity of the composition should be less than about 10 cps to ensure good spreading of the finish on the yarns.

A large number of spin and process finish compositions have been developed over the years. The composition of such finishes, of course, depends on the specific process requirements. Typically, a key consideration in formulating suitable compositions is the viscosity of the oil component of the finish since such was observed to influence the number of broken filaments and the tackiness of the snow formed on the texturings disks. Thus, it has been observed that, in terms of optimizing the composition with respect to the snow formation, the viscosity of the initial oil-based composition ideally should be less than 60 cps at 45° C., while a higher viscosity is needed at intermediate water contents during the processing.

Despite the careful controlling of the viscosity of the oil component or, at most, of the initial water/oil emulsion, the treated yarns have nonetheless not been completely satisfactory but rather, have often exhibited mediocre or poor package build characteristics and poor yarn bundle coherence properties.

SUMMARY AND OBJECTS OF THE INVENTION

In view of the foregoing limitations and shortcomings of prior art spin and processing finish compositions as well as other disadvantages not specifically mentioned above, it should be apparent that there still exists a need in the art for a finish composition which, in addition to imparting desirable properties to the spun yarns in terms of the number of broken fils as well as the tackiness of the snow formed on the texturings disks, also imparts desirable package build and spin line coherence characteristics. It is therefore a primary objective of the present invention to fulfill that need by providing a spin or process finish composition based on the fact that water rapidly evaporates from the finish after its application onto the yarns and that the viscosity of the finish as a function of this observed decrease in the water content markedly affects both the package build and spin line coherence properties of the finish.

More particularly, it is an object of this invention to provide a spin or process finish composition having an associative thickener which does not affect significantly the viscosity of the initial oil-based finish composition but which effects a rapid increase in the viscosity of the applied composition as water evaporates therefrom.

Yet another object of this invention is to provide a spin or process finish composition having incorporated therein an associative thickener which enables the viscosity of the spin or process finish to be controlled as a function of its water content so as to optimize the spin or process finish with respect to all of the aforementioned properties.

Another object of this invention is to provide an associative thickener which is miscible with the oil base of the finish and can be diluted into homogeneous water solutions.

It is a further object of this invention to provide a method of treating spun yarns with the spin or process finish compositions of the present invention containing an associative thickener.

In a first aspect, the present invention provides a spin or process finish composition comprising;

(A) from about 70 to about 99.5% by weight water; and (B) from about 0.5 to about 30% by weight of an oil-based composition comprising:

(i) a lubricating oil in an amount sufficient to achieve the lubrication of a material contacted with the composition;

(ii) an emulsifier in an amount sufficient to emulsify the lubricating oil and the water; and (iii) an associative thickener in an amount which does not substantially affect the initial viscosity of the spin finish composition yet causes a substantial and rapid increase in the viscosity of the composition as the water contained therein decreases from its initial level, and has no substantial affect on the viscosity of the composition as the water contained therein decreases to below 40%.

In another aspect, the present invention provides a process for treating yarns with the water-based spin or process finish composition of the present invention containing an associative thickener.

With the foregoing and other objects, advantages, and features of the invention that will become hereinafter apparent, the nature of the invention may be more clearly understood by reference to the following detailed description of the invention, the appended claims and the drawings.

DETAILED DESCRIPTION OF PREFERRED EMBODIMENTS

Figure 1:
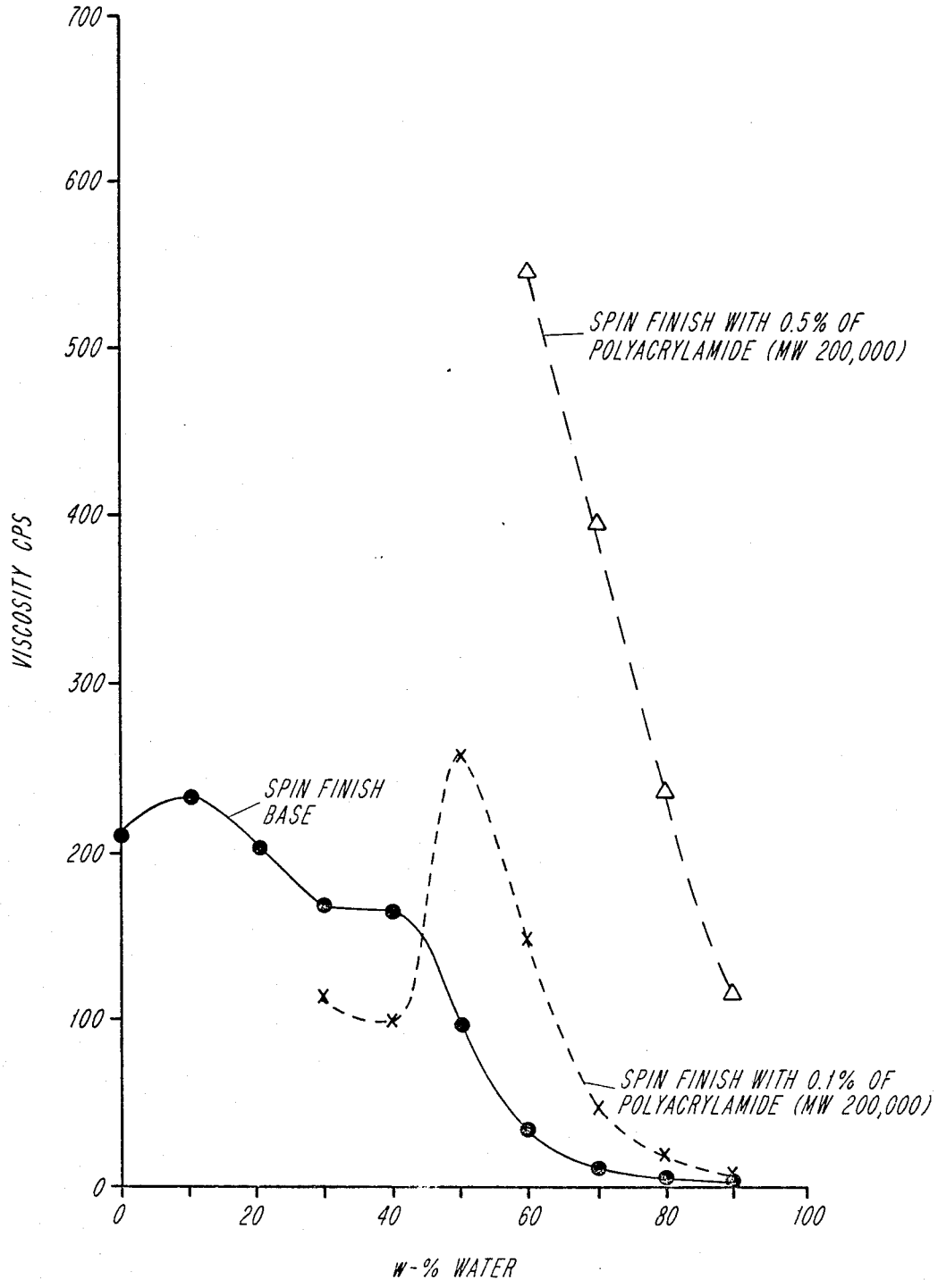
FIG. 1 depicts the variation in viscosity as a function of water content of a spin finish modified with 0.1% and 0.5% of polyacrylamide.

As a result of the associative thickeners of the invention, finish compositions are produced which exhibit good spreadability when applied to the yarns, exhibit a rapid and substantial initial increase in viscosity as water evaporates from the compositions, and have relatively little affect on the viscosity profile at water contents less than 40%. Preferably, in order to obtain good package build, the finish compositions containing the associative thickeners also exhibit a relatively unaffected viscosity profile in the 40–60% by weight water content range.

As mentioned above, previous attempts at formulating finish compositions have generally focused on the viscosity of the oil base component or, at most, on the viscosity of the initial oil/water emulsion which is applied to the yarns. Such a focus, however, has proven to be unduly narrow since it has been observed that a high degree of evaporation of water and possibly other volatile components occurs during the application process as well as after the spin finish has been applied. Accordingly, the moisture content of the applied spin finish on a freshly spun package may be 50% or even lower depending on the spinning speed i.e., the air flow velocity and its turbulence along the spin line, humidity and temperature at the spin line, yarn bundle configuration (related to surface area), finish distribution on the yarn bundle and, to a certain extent, the finish composition. The water content of process finishes, such as drawframe finishes, depends on the drying conditions.

Since water or other volatile components evaporate from the finish composition during or after its application, an increase in viscosity occurs. The nature of that increase has now been observed to affect the package build and yarn bundle coherence properties of the spun yarns. More specifically, in order to obtain good package build and good yarn bundle coherence, the spin finish should exhibit a rather rapid initial viscosity increase as water evaporates from the composition, such as at least about 100 cps, preferably at least about 150 cps as the water content decreases to about 70 to 90% by weight or less. Additionally, the finish composition should exhibit a viscosity generally ranging from 150 to 600 cps and preferably 200 to 400 cps as determined by standard techniques (e.g., a Brookfield viscometer) under low or intermediate shear conditions when the water content in the composition is reduced to about 50%.

An ideal spin finish therefore should have:

(i) a low viscosity at application concentrations e.g., less than 100 cps, preferably less than 10 cps when the water content is at the initial 70–99.5% level and especially at the 90–99.5% level, to allow a quick spreading across the yarn bundle;

(ii) a rapid viscosity increase upon initial evaporation of water to 70 to 90% or less of the spin finish to yield good yarn bundle coherence;

(iii) an intermediate viscosity of 150 to 600 cps, preferably 200 to 400 cps at water contents of 40–60% by weight to yield good package build; and (iv) a low oil viscosity e.g., less than about 60 cps at 45° C. to diminish the number of snow deposits as well as the number of broken fils at texturing.

As previously indicated, spin finish compositions have typically been prepared by focusing on the properties of the oil component or of the initial oil/water emulsion which is applied. Not surprisingly, the formulation of a spin finish composition which is ideal in terms of the number of snow deposits, the number of broken filaments at texturing, package build, yarn bundle coherence, and initial spreadability has proven elusive in the art. Thus, one finish was shown to give excellent package build and low snow at texturing but, nevertheless, showed problems with respect to the number of broken fils when octalobal partially oriented yarns were treated. Another spin finish composition showed good broken fil protection but gave heavy snow deposits and poor package build. Yet another composition showed excellent texturing performance but again exhibited poor package build.

In order to obtain a spin finish composition more closely approximating the ideal compositions described above, it was proposed to incorporate therein standard water thickeners such as xanthan gum or a polyacrylamide. Although xanthan gum caused a rapid linear increase in viscosity as the water content decreased, water contents less than 50% could not even be examined since xanthan gum gel has a low and slow solubility in water and thus does not perform well as the water contents are decreased to any degree.

The incorporation of 0.1% by weight of a polyacrylamide viscosity modifier into a conventional spin finish composition was observed to have no initial effect on the viscosity of the composition thus making its use advantageous in terms of spreadibility. Additionally, as the water content decreased to 50% by weight, the viscosity of the spin finish composition reached a maximum value of 250 cps as determined by a Brookfield cone-plate micro viscometer with further decreases in the water content resulting in a sharp decrease in the viscosity.

Although the 250 cps viscosity levels corresponding to a water content of 50% are desirable in terms of obtaining good package build, it is difficult in practice to control the water contents of the spin finish compositions with such precision. More specifically, the rate at which water evaporates from the composition will obviously be a function of the temperature and humidity of the environment as well as other processing factors. Accordingly, large variations in the percent water in the spin finish compositions can be expected to occur upon application thereof. It therefore becomes apparent upon perusal of FIG. 1 that the polyacrylamides will not suffice as viscosity modifiers since a mere decrease in the water content of the spin finish composition from 50% to 40% will result in a decrease in the viscosity from about 250 cps to about 100 cps. It will be appreciated that at 100 cps, the spin finish will not impart the desired package build.

Other conventional viscosity modifiers examined exhibited similar behavior to the polyacrylamides, i.e., poor package build at the 40–60% water content range. For example, a spin finish containing 5% (based on the oil component) of polyethylene oxide had a viscosity of about 75 cps at a 60% water content but a viscosity of nearly 500 cps at about a 55% water content. Thus, seasonal variations in temperature and humidity could have drastic effects on the quality of the treated yarns obtained.

The associative thickeners of the present invention are added to conventional spin finish compositions. Such compositions generally comprise:

| | |
|---|---|
| Water | 70 to 99.5, preferably 85–92 wt. % |
| Added to the water is 30 to 0.5 wt. % of an oil-based component containing on an oil basis: | |
| lubricant | 1 to 90, preferably 20–60 wt. % |
| emulsifier | 5 to 50, preferably 10–30 wt. % |
| anti-static agent | 0.5 to 20, preferably 5–10 wt. % |
| other (bacteriacides, antioxidants, etc.) | 0 to 20, preferably 2–10 wt. % |

Suitable lubricants include, but are not limited to substances such as palm oil, coconut oil, cottonseed oil, mineral oil, glycerides, polyglycol esters, butyl stearate, octyl stearate, esters of oleic acid, trimethylolpropane/-caprylic acid esters, 2-methyl-2-propylpropane-1,3-diol-dilaurate, 2-ethyl-2-butyl-propane-1,3-dioldilaurate, polysiloxanes certain polyethylene oxide polypropylene oxide adducts and the like.

The lubricant is preferably dispersed in water with the aid of an emulsifying agent including surface active organic compounds such as fatty acid salts, higher fatty alcohols, sorbitol esters or sorbitans, phosphate esters, sulfonated aromatic petroleum hydrocarbons, sulfonated naphthenates, sulfated vegetable oils, polyoxyethylene esters and ethers, polyglycerol esters, glycerol mono-di-fatty acid esters and the like.

Anti-static agents are added to reduce the electrostatic charge of the filament during its subsequent processing. Useful agents include cationic compounds containing a quarternary ammonium-, pyridium-, imidazolinium-, and quinolinium function, and phosphated alcohols, ethyloxated amides and the like.

The associative thickeners are present in an amount ranging from about 0.1 to about 15%, preferably from about 1 to about 5% by weight based on the components of the spin finish exclusive of water, i.e., the oil base. The associative thickeners must be compatible with the spin finish compositions in that they do not substantially adversely affect the beneficial results obtained from the other components of the composition. Generally, they are polymeric surfactant-type compounds which act as a bridge between droplets in the spin finish emulsion. More specifically, by virtue of a hydrophilic backbone and at least two pendent hydrophobic side chains, the associative thickeners of the present invention, when present above a certain concentration in the water, form associative structures which give viscosity values which are surprisingly high in light of the relatively low molecular weight of the polymers. Without being limited to theory, it is believed that the hydrophobic side chains of the associative thickeners have the capability of competing with surfactants at an emulsion droplet interface. More specifically, the pendent hydrophobic side chains on one molecule interact with the different emulsion droplets or micelles and thereby act to cross-link them. By virtue of the interaction of the associative thickeners, far greater increases in viscosity are observed than would be expected if the viscosity increase were attributable solely to a thickening of the aqueous component.

The amount of a particular associative thickener is selected such that it does not substantially affect the initial viscosity of the spin finish, yet causes a substantial increase in the viscosity of the composition as the water content decreases from its initial level and effects no substantial change in the viscosity as the water content further decreases to below about 40%. In order to obtain good package build, it is additionally desired to incorporate an amount of associative thickener into the spin finish which will exhibit an intermediate viscosity in the 40–60% by weight water content range.

To determine whether a particular associative thickener meets the foregoing criteria, the finish composition without the associative thickener is first prepared and its viscosity is determined such as by a Brookfield viscometer. The finish composition is then prepared with the associative thickener present and its viscosity (i.e., the initial viscosity) is again determined. Typically, the viscosity of the spin finish composition with the associative thickener present will increase less than about 20 cps and preferably less than about 10 cps as compared to the composition which does not include the associative thickener.

The water content of the finish composition is then reduced (e.g., by evaporation of the preparation) and the viscosity again determined and compared with the initial viscosity. Typically, as the water content drops to below about 90%, there will be an increase in viscosity of from about 10 to 1000 cps.

A wide variety of associative thickeners may be employed. One associative thickener found suitable for the present invention is based on copolymers of 1,3-dioxolane and aliphatic 1,2 epoxides. These copolymers are described in detail in U.S. Pat. No. 4,415,701, the disclosure of which is hereby incorporated by reference. Specifically, 1,3 dioxolanes of the formula:

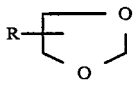

wherein R is either hydrogen or $C_1$–$C_3$ alkyl, are reacted with a $C_{10}$–$C_{36}$ monoepoxide of the formulae:

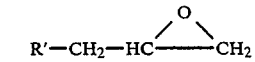

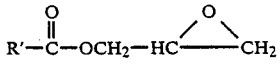

or

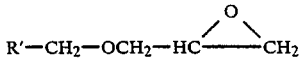

wherein R′ is $C_7$–$C_{33}$, preferably $C_9$–$C_{22}$. Additionally, up to 25% by weight, based on the total monoepoxide weight, of an alkyl or any monoepoxide containing less than about 10 carbon atoms may be used as a comonomer. Examples of such monoepoxides include butyl glycidyl ether, phenyl glycidyl ether, ethylene oxide, propylene oxide, butylene oxide and the like. 10% by weight of monoepoxide of an aromatic or aliphatic polyepoxide may also be added.

The 1,3 dioxolane monomer may contain up to 10% by weight of trioxane based on the total 1,3 dioxolane weight.

The reaction between the epoxide and dioxolane is catalyzed using well known cationic polymerization catalysts.

Other materials suitable for use as associative thickeners are the materials described in U.S. Pat. Nos. 3,393,157; 4,288,639; 4,302,349 and 4,304,902 as well as the nonionic polymer surfactants described in the article "Nonionic Polymer Surfactants" by C. M. Landoll, Journal of Polymer Science; Polymer Chemistry Edition, Vol. 20, p. 443–455 (1982) the disclosures of which are all incorporated by reference.

Thus, for example, suitable materials include polymers formed from cyclic ethers and/or cyclic acetals to produce polymeric materials not exclusively composed of oxymethylene groups. Specifically, a cyclic ether having the formula:

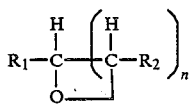

wherein $R_1$ and $R_2$ are each alkyl, cycloalkyl, aryl, alkoxy or aryloxy and n has a value of 1 to 4, or a cyclic acetal having one of the following formulae:

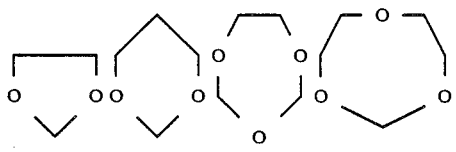

or a mixture of any of the cyclic ethers and/or acetals among themselves or with a cyclic acetal having the formula:

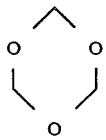

is polymerized in the presence of a catalyst consisting of $SO_3$.

Another example of a suitable material is represented by the formula:

$$R[O-(CH_2CH_2O)_x-(\underset{R'}{CH}-\underset{R''}{CH}-O)_y-H]_z$$

wherein z is 1 or 2; R, for z=1, is alkyl, aralkyl, or alkylaryl of 8–22 carbon atoms in the alkyl chain, or hydroxyalkyl of 2–22 carbon atoms, and, for z=2, is (aryl) alkylene of 4–18 carbon atoms, R′ and R″ each independently is hydrogen or $C_1$–$C_{20}$ alkyl wherein R′ and R″ are not simultaneously hydrogen and R′ and R″ together have 8–20 total carbon atoms, x is 10–40 and y is 1.2–5.

The above-described compounds can be prepared by reacting a compound $R(OH)_z$ in the presence of a basic or acidic catalyst first with ethylene oxide and then with an epoxyalkane of the formula:

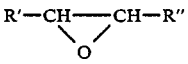

A still further example of suitable materials are copolymers of ethylene oxide and epoxy-n-alkane of 12 to 25 carbon atoms. These copolymers contain 96 to 99.9% by weight of ethylene oxide and 4 to 0.1% by weight of the epoxy-n-alkane and have a molecular weight of between 200,000 and 800,000.

The group of associative thickeners disclosed in U.S. Pat. No. 4,288,639 have been found particularly advantageous for use in the spin finish compositions of the present invention. They comprise alpha-olefin oxide-modified liquid polyether thickeners which are obtained by capping with an alpha-olefin oxide, a liquid straight-chain polyoxyalkylene heteric or block copolymer intermediate which is prepared by reacting ethylene oxide and at least one other lower alkylene oxide having 3 to 4 carbon atoms with an active hydrogen containing aliphatic or alkylaromatic initiator having only one hydrogen atom and about 12 to about 18 aliphatic carbon atoms.

Alternatively, the thickeners can be prepared by copolymerizing a mixture of ethylene oxide and the lower alkylene oxides in the presence of the alpha-olefin oxide. In addition, ethylene oxide homopolymers capped with the alpha-olefin oxide are useful. The thickeners are said to exhibit an unexpected thickening efficiency in aqueous systems as compared with more conventional polyether thickeners of the same molecular weight.

The disclosed use of the thickening agent of U.S. Pat. No. 4,288,639 is as a component of water based hydraulic fluids such as that currently marketed under the trademark Plurasafe®, which is registered to BASF Wyandotte Corporation.

The physical properties of a group of associative thickeners employed in the Examples of the invention are set forth in the Table below:

TABLE I

| Thickener | % Vikolox* added | 1,2-epoxide alkyl chain | Average of 5% solution cps | molecular weight |
|---|---|---|---|---|
| A | 5 | $C_{20-24}$ | 100 | — |
| B | 10 | $C_{18}$ | 112,000 | 17,500 |
| C | 5 | $C_{16}$ | 16,400 | 28,000 |
| D | 5 | $C_{16}$ | 950 | 33,000 |
| E | 5 | $C_{16}$ | 1,400 | — |

*Vikolox is a series of monoepoxide compounds available from Viking Chemical Company. For example, Vikolox 20–24 is a mixture of 47% $C_{20}$, 44% $C_{22}$ and 9% $C_{24}$ carbon-containing monoepoxides having an average molecular weight of 313 and a melting point of 34–40° C.

The spin finish composition, including one of the above-described associative thickeners of the referenced patents or Table I, may be applied to the spun yarns by any conventional technique such as by applying the spin finish composition to the yarns immediately after the spinning operation by passing the yarns through a trough or having the yarns make contact with a "kiss" roll rotating in a trough fitted with the spin finish. The spin finish may also be applied by spraying.

The finishes are typically applied to the material at the rate of 0.01 to 5% and preferably at 0.1 to 1% by weight of the material. It will be appreciated that the amounts are dependent on the processing conditions and are easily ascertained by one of ordinary skill in the art.

The yarns or the like treated with the modified spin finishes are typically formed of polyethylene terephthalate although the invention may be practiced in conjunction with other materials such as nylon, polypropylene, vinyl acetate, polybenzimidazole and other natural or synthetic fibers.

The following Examples are given by way of illustration and should not be construed as limiting the subject matter disclosed and claimed.

EXAMPLE 1

Figure 2:
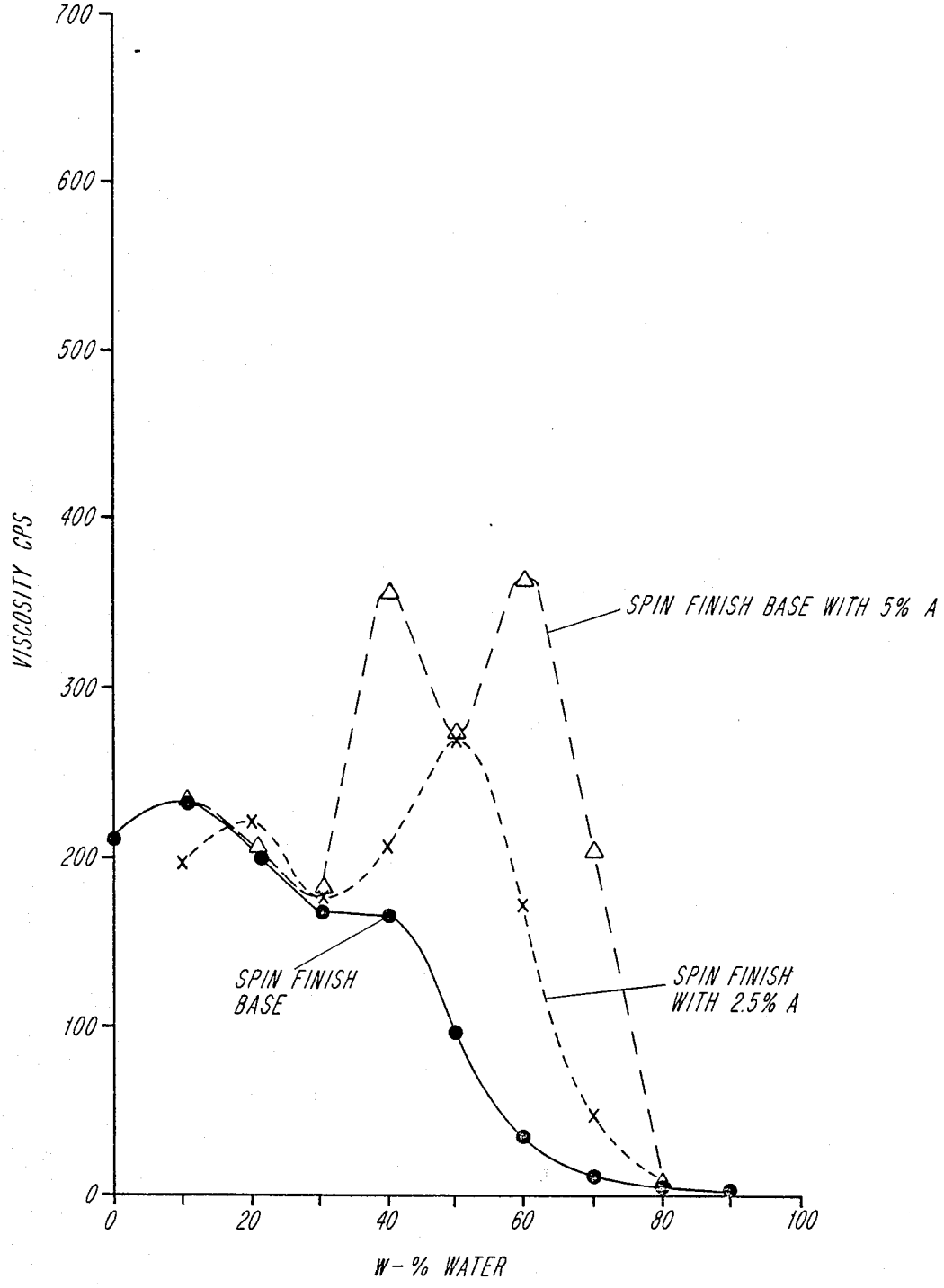
FIG. 2 depicts the variation in viscosity as a function of water content of a spin finish modified with 2.5% and 5% of Thickener A.

Associative thickener A was incorporated into a spin finish oil base comprising 0.5 parts lubricant, 0.4 parts emulsifiers, 0.02 parts antistatic agents, and 0.002 parts antioxidant. The oil base containing the associative thickener A was then added to the water. Specifically, the variation of viscosity as a function of water content was determined for a composition containing 2.5% and 5% of associative thickener based on oil. As is evident from FIG. 2, associative thickener A has no appreciable effect on the composition's viscosity at high water contents when compared to the unmodified finish. However, as water evaporated, an almost immediate difference in viscosity between the modified and unmodified compositions was observed, with the unmodified finish having a viscosity of less than about 50 cps at a 60% water content whereas the viscosity of the modified composition containing 2.5% and 5% of associative thickener A (based on oil) were about 175 cps and 350 cps respectively. It will be appreciated that in the water content range of from 60–40%, the modified compositions never had viscosities lower than about 175 cps in contrast to the unmodified spin finish base. Additionally, at water contents lower than about 40%, the viscosity of the modified compositions are relatively unaffected.

EXAMPLE 2

The same viscosity/water content relationship determined with respect to associative thickener A in Example 1 was repeated with associative thickener B at concentrations of 1%, 2.5% and 5% based on the oil content of the same spin finish described in Example 1.

Figure 3:
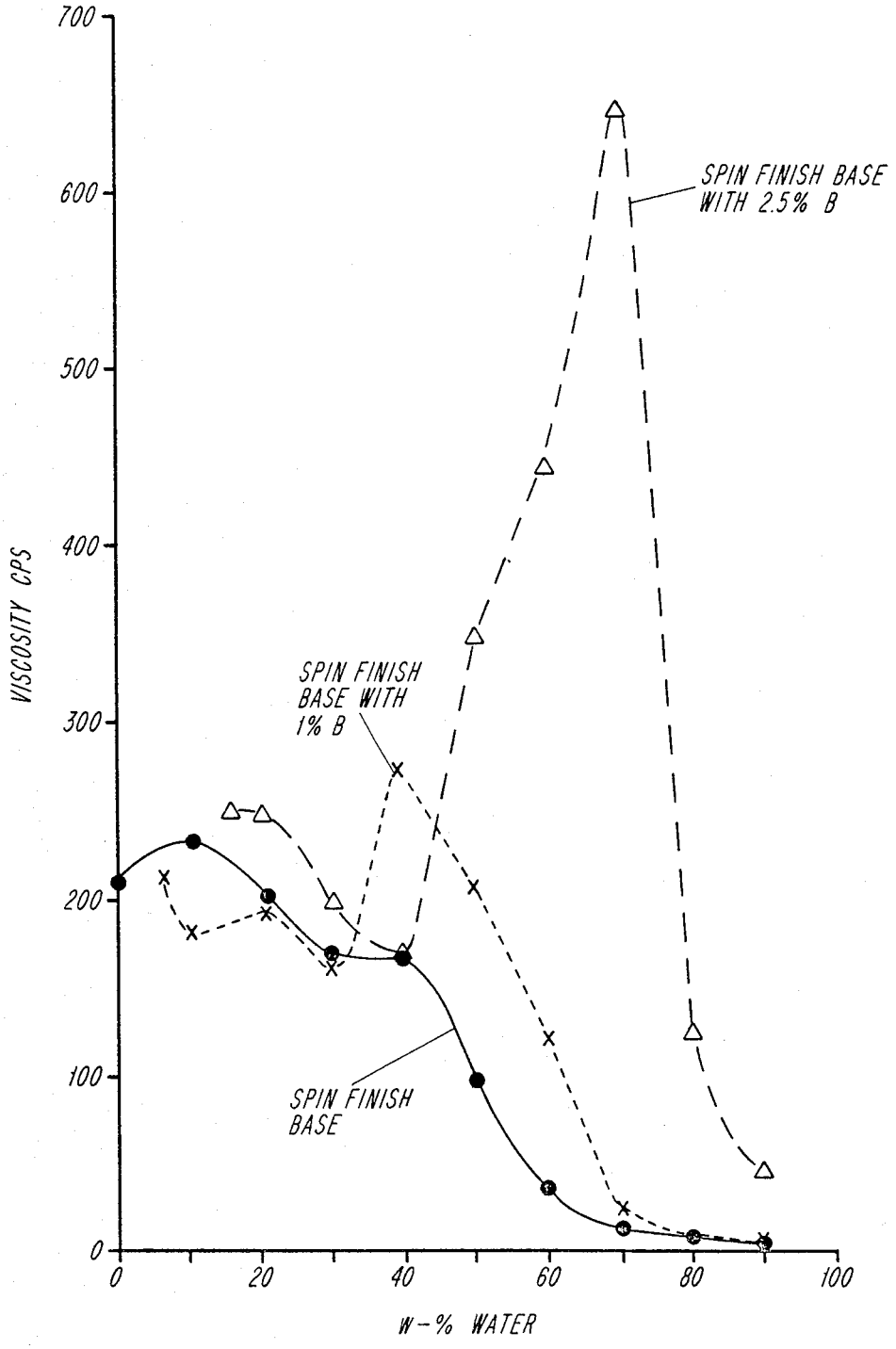
FIG. 3 depicts the variation in viscosity as a function of water content of a spin finish modified with 1% and 2.5% of Thickener B.
Figure 4:
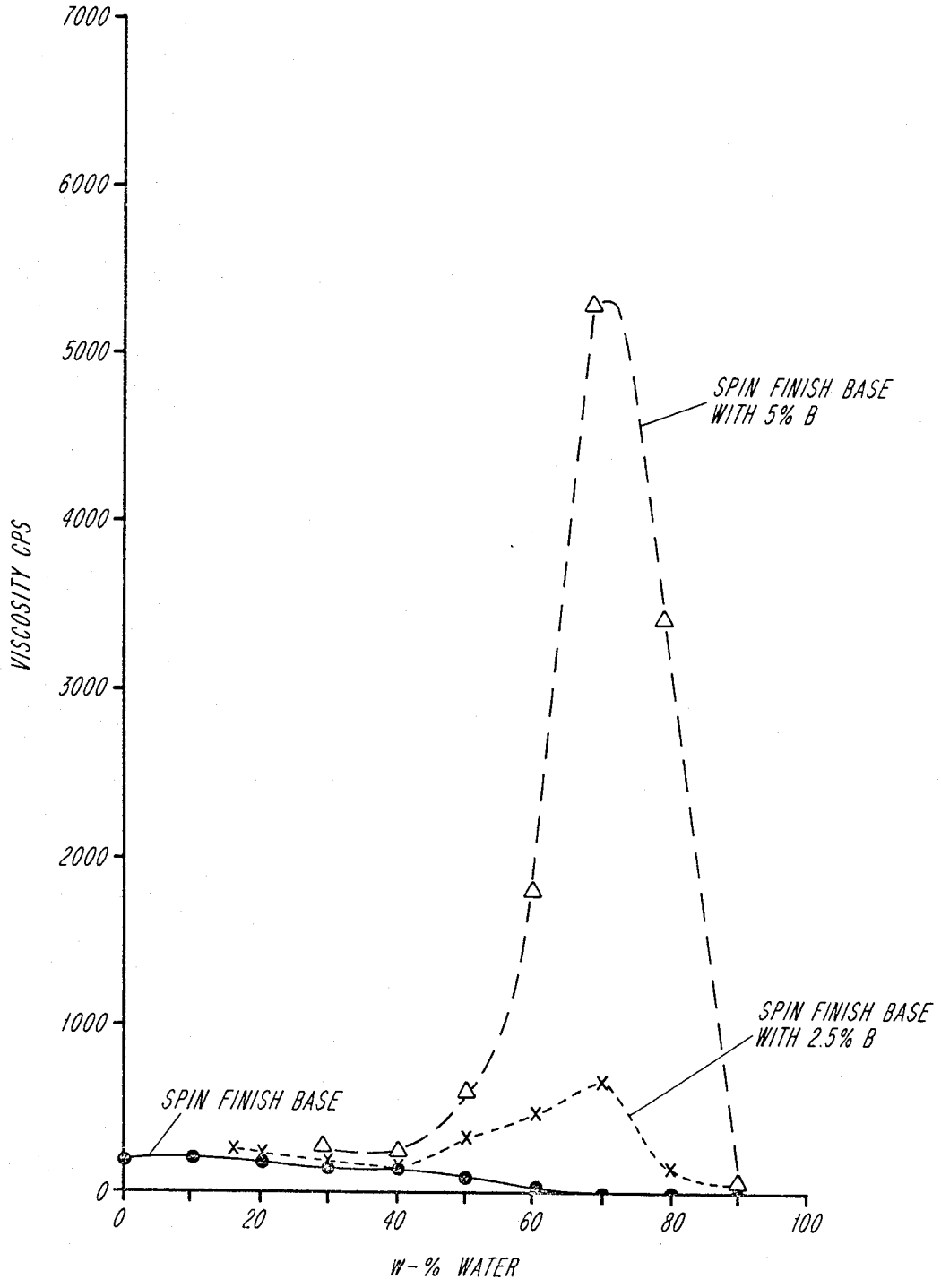
FIG. 4 depicts the variation in viscosity as a function of water content of a spin finish modified with 2.5% and 5% of Thickener B.

As is evident from FIGS. 3 and 4, the modified finishes exhibited far more rapid initial viscosity increases as the water content of the finish decreased than did the unmodified compositions. The modified compositions also exhibited far more desirable viscosity characteristics in the 40–60% water content range and exhibited a substantially unaffected viscosity profile at water contents lower than about 40%.

EXAMPLE 3

Figure 5:
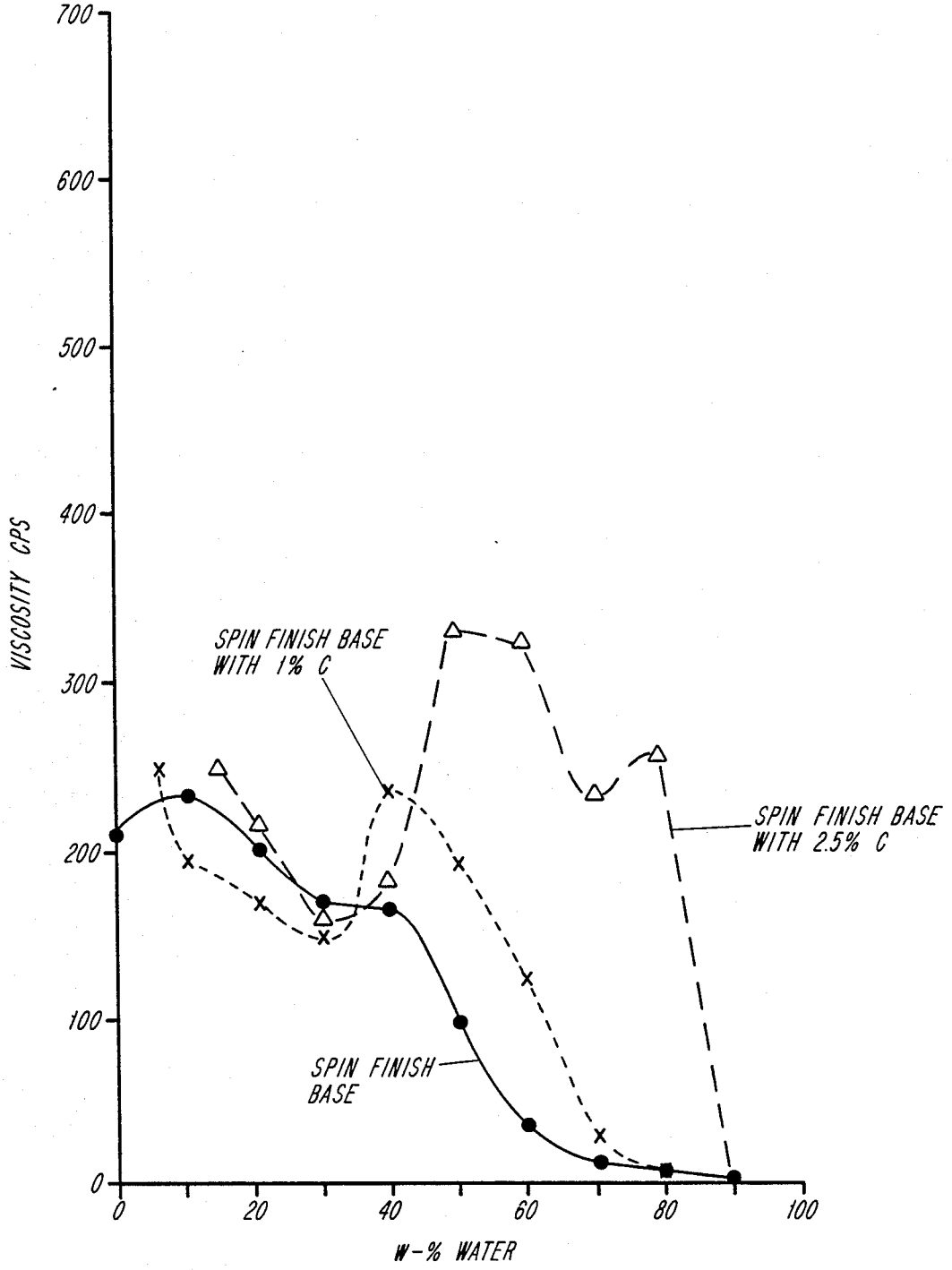
FIG. 5 depicts the variation in viscosity as a function of water content of a spin finish modified with 1% and 2.5% of Thickener C.

The viscosity/water relationship of the spin finish of Example 1 modified with 1% and 2.5% (on oil) of associative thickener C was determined. As shown in FIG. 5, a far sharper initial increase in viscosity with decreasing water content was observed for the modified spin finishes than with the unmodified spin finishes. Likewise, in the critical 40–60% water content range, the modified spin finishes of the the present invention exhibited far more desirable viscosity characteristics. For example, the viscosity of the spin finish containing 2.5% of associative thickener C varied from about 300 cps to about 200 cps in the 40–60% water content range whereas the unmodified finish varied from less than 50 cps to about 150 cps.

EXAMPLE 4

Figure 6:
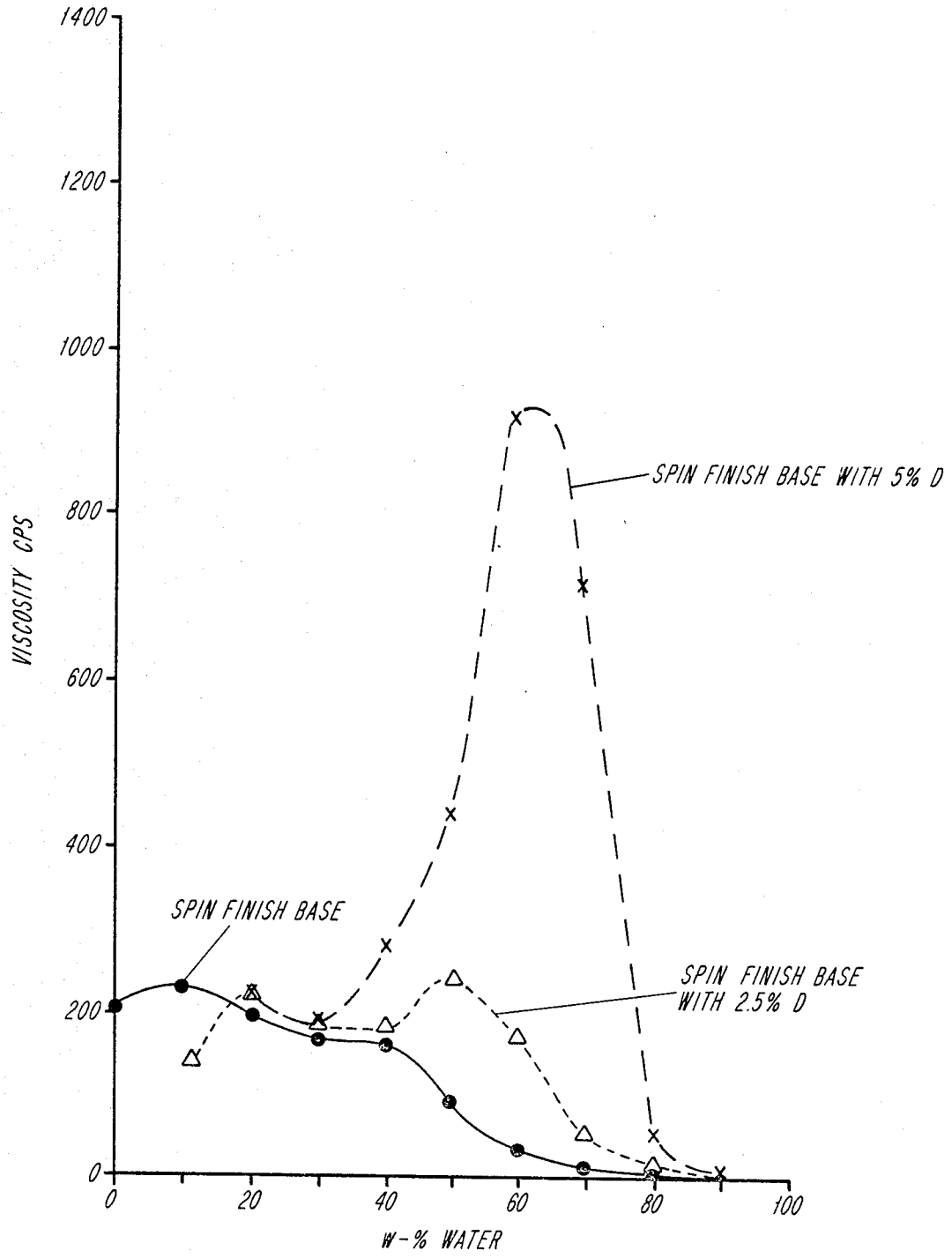
FIG. 6 depicts the variation in viscosity as a function of water content of a spin finish modified with 2.5% and 5% of Thickener D.

The same viscosity/water relationship was determined for the spin finish of Example 1 modified with 2.5% and 5% (on oil) of associative thickener D. As FIG. 6 demonstrates, there was once again a far greater initial viscosity increase observed with respect to the modified finish than with the unmodified finish. The viscosity of the modified compositions in the 40–60% water content range were likewise superior to the unmodified spin finishes.

EXAMPLE 5

Figure 7:
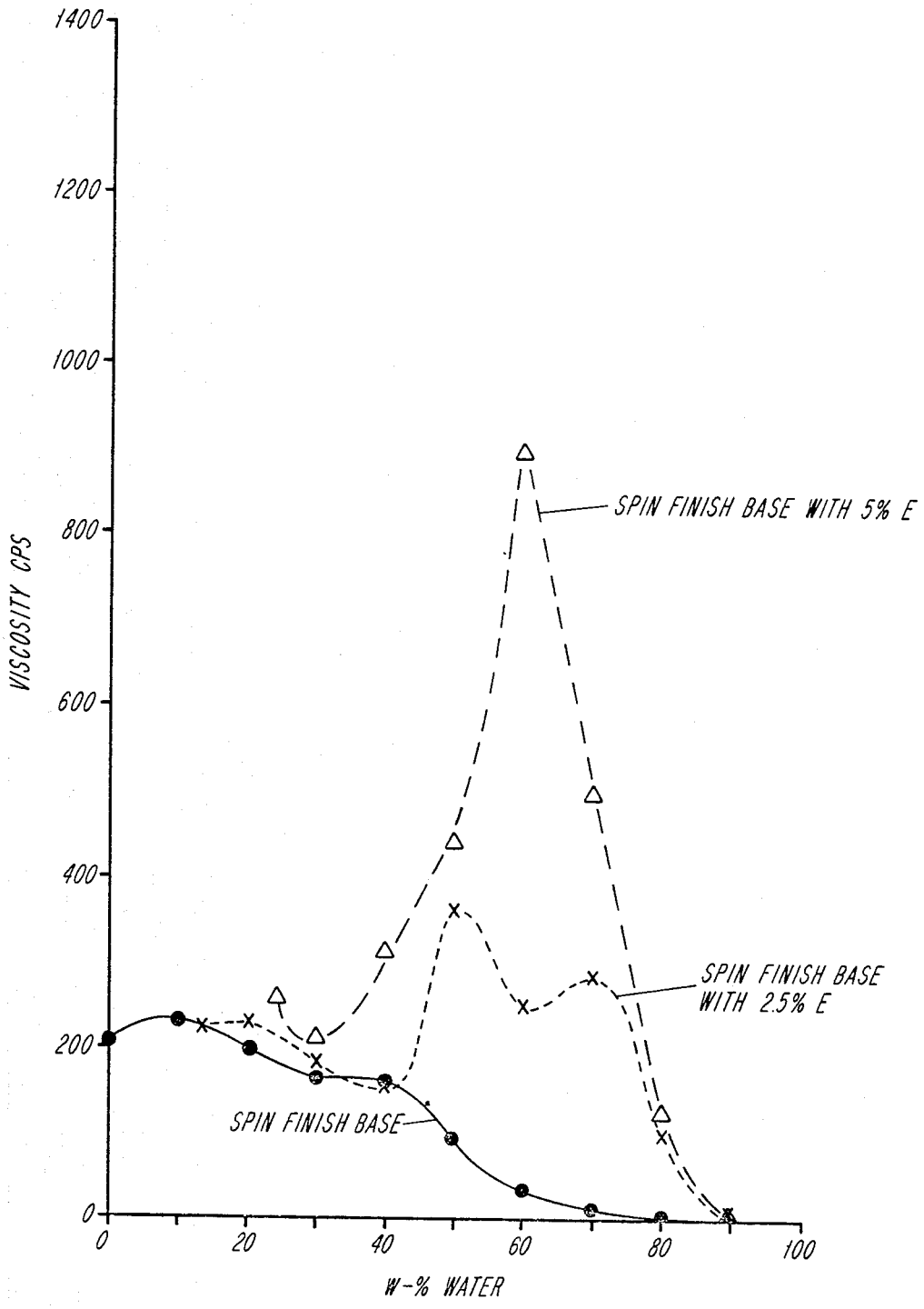
FIG. 7 depicts the variation in viscosity as a function of water content of a spin finish modified with 2.5% and 5% of Thickener E.

The viscosity/water relationship for the finish of Example 1 modified with 2.5% and 5.0% (on oil) of Thickener E was determined. Once again, as demonstrated by FIG. 7, there was a far greater initial viscosity increase as well as a more desirable viscosity profile in the 40–60% water content range.

EXAMPLE 6

Figure 8:
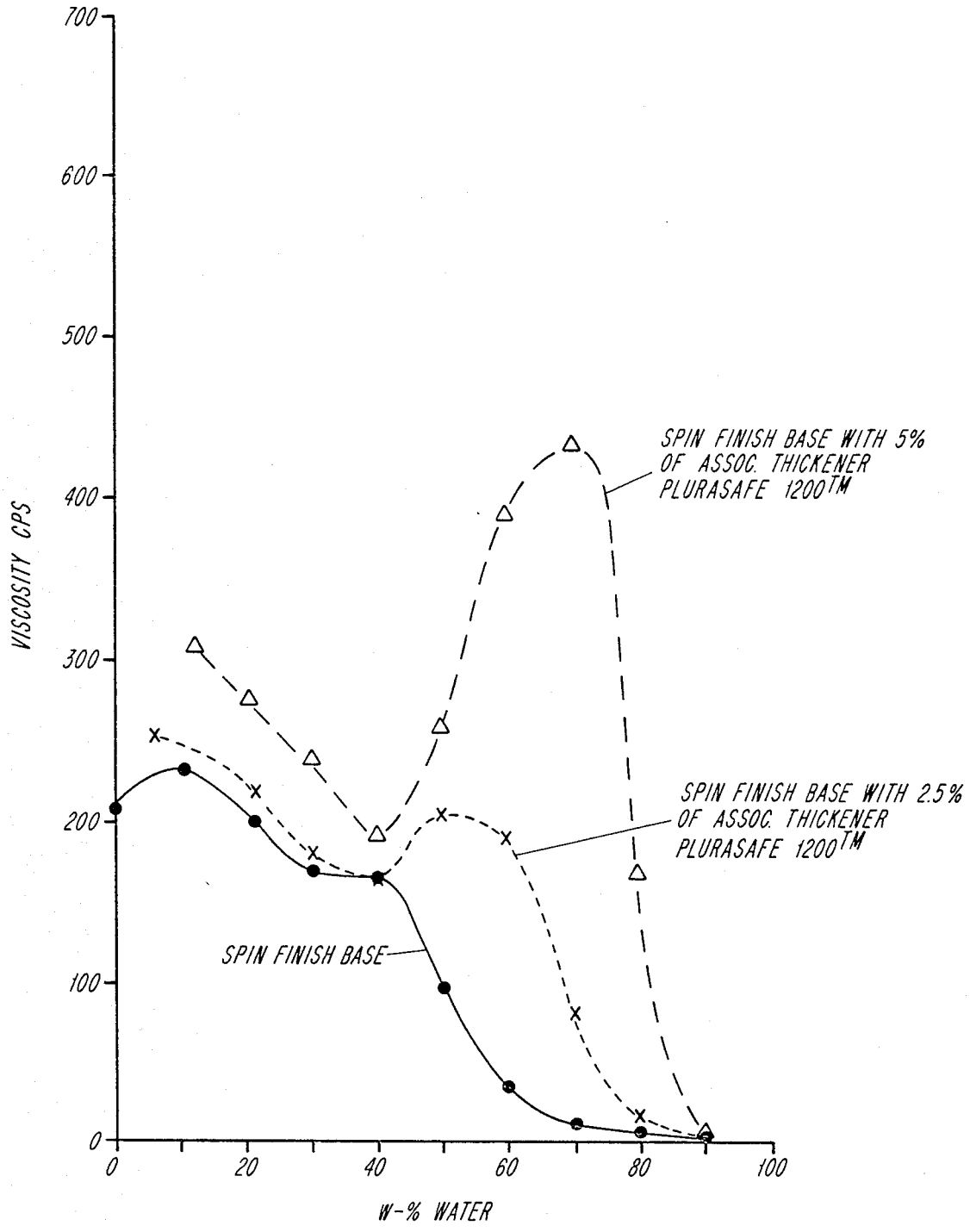
FIG. 8 depicts the variation in viscosity as a function of water content of a spin finish modified with 2.5% and 5% of PLURASAFE 1200®.

The viscosity/water relationship for the finish of Example 1 modified with 2.5% and 5% (on oil) of PLURASAFE 1200® was determined. As shown in FIG. 8, a far more rapid initial viscosity was again observed. Additionally, the finish modified with associative thickeners exhibitied especially desirable viscosity characteristics in the 40–60% water content range, with the 5% modified thickener varying in viscosity from under 400 cps to about 200 cps.

EXAMPLE 7

Figure 9:
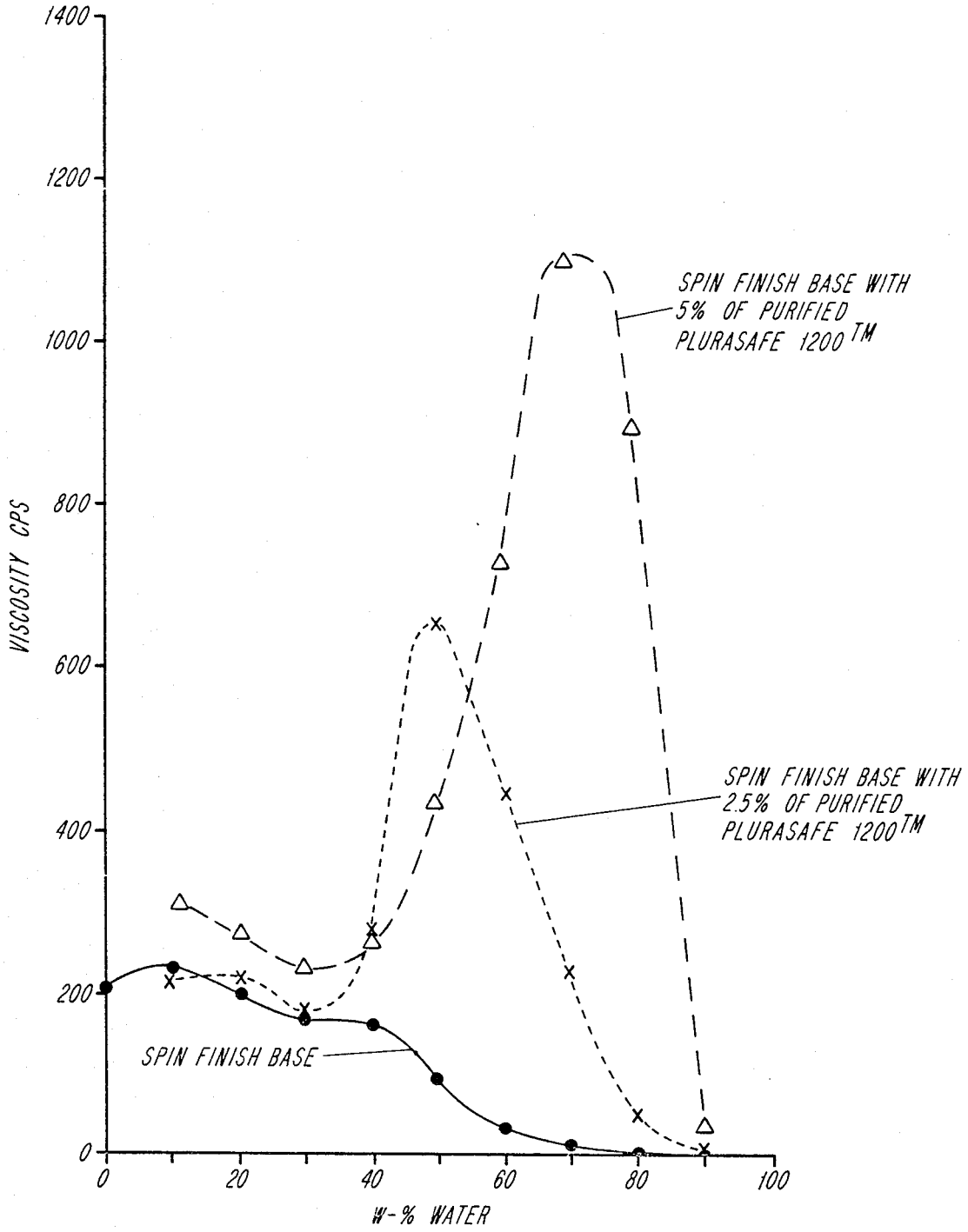
FIG. 9 depicts the variation in viscosity as a function of water content of a spin finish modified with 2.5% and 5% of purified PLURASAFE 1200®.

The viscosity/water relationship of the finish of Example 1 modified with a purified PLURASAFE 1200® was determined. A water solution of the PLURASAFE was heated above the cloud point, i.e., the temperature at which the polymeric nonionic surfactant no longer was water soluble. The solution was kept at this temperature until good phase separation between a water phase reacts in PLURASAFE and a water solution containing other components was obtained. The PLURASAFE phase was collected, diluted with cold water and the process repeated once more. As FIG. 9 demonstrates, higher initial viscosities and more desirable viscosity behavior in the 40–60% water content range were obtained with the finishes containing the associative thickeners.

EXAMPLE 8

Figure 10:
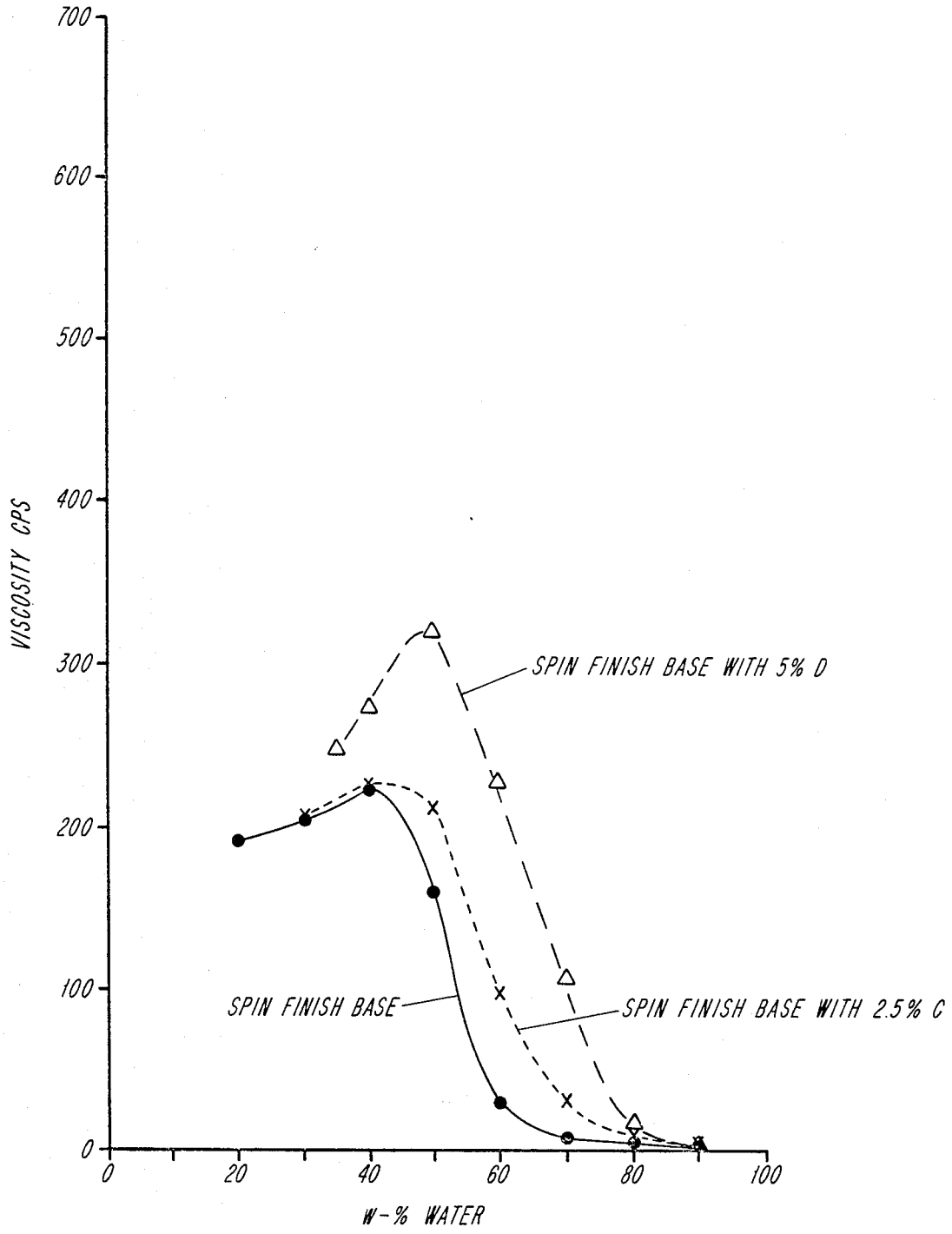
FIG. 10 depicts the variation in viscosity as a function of water content of a spin finish modified with 2.5% Thickener C and 5% of Thickener D.

The effects of the associative thickeners on the viscosity of a spin finish comprising 20 parts water, and an oil base comprising 42 parts lubricant, 35 parts emulsifier and 3 parts antistatic agent were determined. Specifically, the spin finish was modified with 2.5% (on oil) of Thickener C and 5% (on oil) of Thickener D. As demonstrated by FIG. 10, higher initial viscosity increases as well as more desirable viscosity behavior in the 40–60% water content range were obtained with the finishes containing the associative thickeners.

EXAMPLE 9

Figure 11:
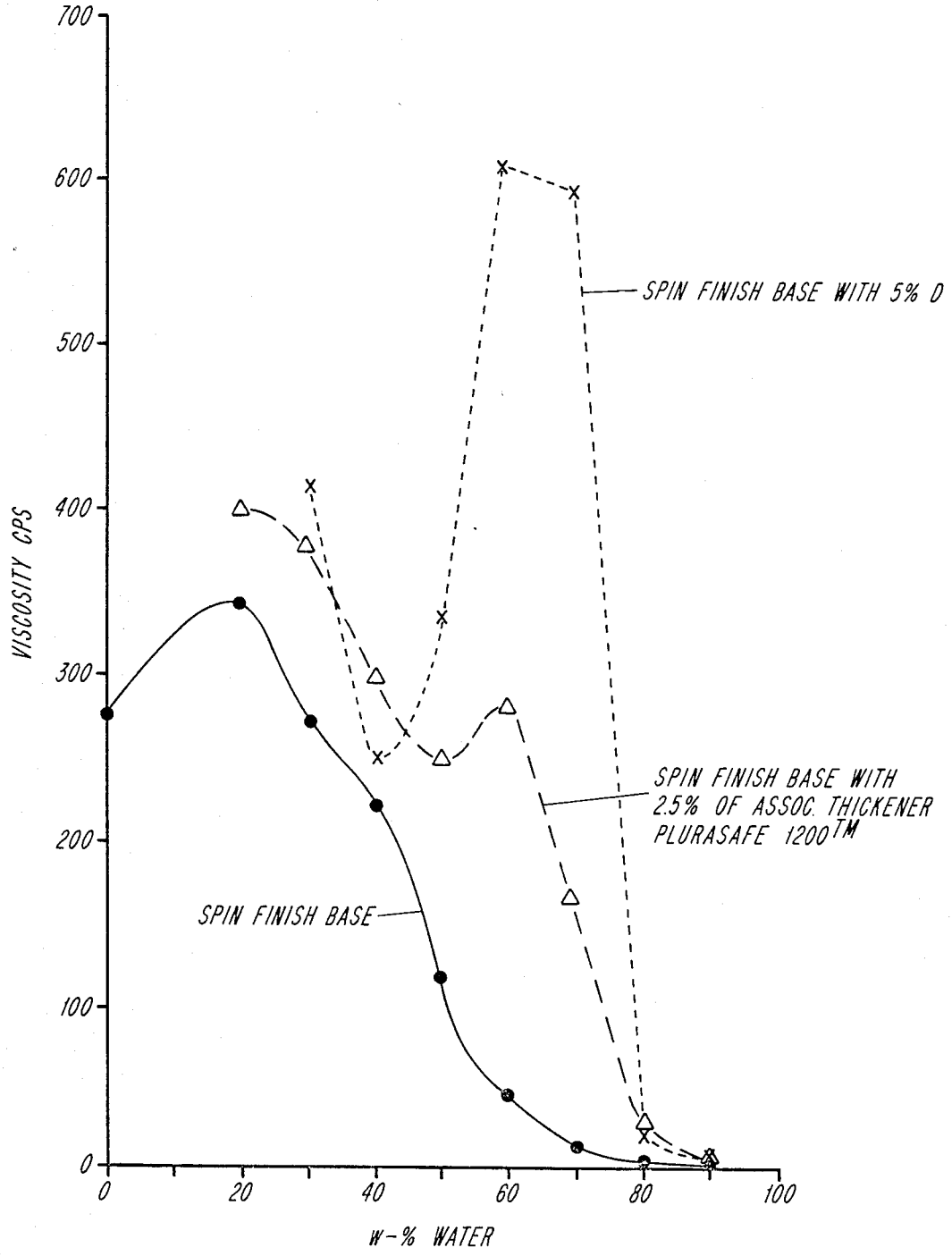
FIG. 11 depicts the variation in viscosity as a function of water content of a spin finish modified with 2.5% Plurasafe 1200 and 5% of Thickener D.

The viscosity/water relationship of a spin finish oil base comprising 77 parts lubricants, 21 parts emulsifiers and 0.4 parts antistatic agent and 0.2 parts of antioxidant modified with 2.5% (on oil) of PLURASAFE 1200® and 5% (on oil) of Thickener D were determined. As shown in FIG. 11, the PLURASAFE modified finish exhibited especially desirable viscosity behavior. More specifically, in addition to exhibiting a rapid initial viscosity increase, the modified spin finish had a viscosity ranging from about 250 to under 400 cps in the 40–60% water content range.

The following Table summarizes the results obtained in the Examples set forth above:

TABLE II

| SPIN FINISH | ASSOCIATIVE THICKENER % (ON OIL) | INITIAL VISCOSITY INCREASE | VISCOSITY (cps) BEHAVIOR IN 40–60% WATER CONTENT RANGE |
|---|---|---|---|
| Example 1 | — | small | 30–150 |
| Example 1 | A (2.5%) | very rapid | 150–200 |
| Example 1 | A (5%) | very rapid | 275–350 |
| Example 1 | B (1%) | moderate | 100–250 |
| Example 1 | B (2.5%) | very rapid | 150–425 |
| Example 1 | B (5%) | very rapid | 300–1800 |
| Example 1 | C (1%) | rapid | 125–225 |
| Example 1 | C (2.5%) | very rapid | 200–325 |
| Example 1 | D (2.5%) | moderate | 175–200 |
| Example 1 | D (5%) | very rapid | 275–900 |
| Example 1 | E (2.5%) | very rapid | 175–350 |
| Example 1 | E (5%) | very rapid | 300–900 |
| Example 1 | PLURASAFE 1200 (2.5%) | rapid | 150–200 |
| Example 1 | PLURASAFE 1200 (5%) | very rapid | 200–375 |
| Example 1 | Purified PLURASAFE 1200 (2.5%) | rapid | 275–600 |
| Example 1 | Purified PLURASAFE 1200 (5%) | very rapid | 250–700 |
| Example 8 | — | small | 25–225 |
| Example 8 | C (2.5%) | moderate | 100–200 |
| Example 8 | D (5%) | rapid | 200–325 |
| Example 9 | — | small | 50–225 |
| Example 9 | PLURASAFE 1200 (2.5%) | rapid | 250–300 |
| Example 9 | D (5%) | very rapid | 250–600 |

Thus, the spin finishes containing the associative thickeners exhibited for superior viscosity behavior in terms of both the initial viscosity increase and the level of the viscosity in the 40–60% water content range. Although not shown in the above Table II, the associative thickeners additionally did not cause unduly high increases in the viscosity of the initial finish compositions.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A method for lubricating filaments or yarns during textile processing comprising applying to said filaments or yarns a spin finish composition comprising:

(A) from about 70 to about 99.5% by weight of water; and (B) 30 to 0.5% by weight of an oil-based component comprising:

(i) a lubricating oil in an amount sufficient to achieve lubrication of a material contacted with the composition;

(ii) an emulsifier in an amount sufficient to emulsify the lubricating oil and the water; and (iii) an associative thickener comprising:

(I) copolymers of 1,3 dioxolane and aliphatic 1,2 epoxides;

(II) a polymerized cyclic ether of the formula:

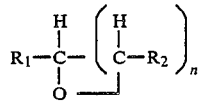

wherein $R_1$ and $R_2$ are each alkyl, cycloalkyl, aryl, alkoxy or aryloxy and n has the value of 1 to 4, or a polymerized cyclic acetal having one of the following formulae:

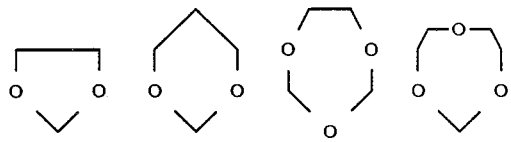

or a mixture of any of the cyclic ethers and/or acetals among themselves or with a cyclic acetal having the formula:

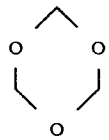

(III) a liquid straight-chain polyoxyalkylene heteric or block copolymer intermediate capped with an alpha-olefin oxide;

(IV) a compound of the formula:

$$R[O-(CH_2CH_2O)_x-(\underset{R'}{\underset{|}{CH}}-\underset{R''}{\underset{|}{CH}}-O)_y-H]_z$$

wherein z is 1 or 2

R is, for z=1, alkyl, aralkyl or alkylaryl of 8–22 carbon atoms in the alkyl chain or hydroxyalkyl of 2–22 carbon atoms, and, for z=2, (aryl)alkylene of 4–18 carbon atoms in the alkyl chain, R′ and R″ each independently is hydrogen of $C_1$–$C_{20}$-alkyl wherein R′ and R″ are not simultaneously hydrogen and R′ alkyl wherein R′ and R″ are not simultaneously hydrogen and R′ and R″ together have a total of 8–20 carbon atoms, x is 10–40 and y is 1.2–5;

(V) copolymers of ethylene oxide and epoxy-n-alkane of 12 to 25 carbon atoms; or (VI) cellulose ethers modified with long-chain hydrocarbon epoxides, the associative thickener being present in an amount which does not substantially affect the initial viscosity of said spin finish composition, yet causes a substantial increase in the viscosity of the composition as the water contained therein decreases from its initial level and effects no substantial change in viscosity as the water content further decreases to below about 40%.

2. The method of claim 1 wherein said associative thickener comprises between about 0.1% and 15% by weight of said composition based on said oil-based component.

3. The method of claim 2 wherein said associative thickener comprises between about 1 and 5% by weight of said composition based on said oil-based component.

4. The method of claim 1 wherein said lubricating oil comprises between about 1 and about 90% by weight of said oil-based component.

5. The method of claim 1 wherein said lubricating oil comprises between about 20 and about 60% by weight of said oil-based component.

6. The method of claim 1 wherein said thickener comprises an ethylene oxide/propylene oxide copolymer end-capped at both ends with twelve to eighteen carbon atom ether linkages.

7. The method of claim 1 further comprising between about 0.5 to about 20% by weight of an anti-static agent.

8. The method of claim 7 further comprising between 5 and about 10% by weight of an anti-static agent.

9. The method of claim 1 wherein said emulsifier comprises between about 5 and about 50% by weight of said oil-based component.

10. The method of claim 9 wherein said emulsifier comprises between about 10 and about 30% by weight of said oil-based component.

11. The method of claim 1 wherein said lubricating oil is palm oil, coconut oil, cottonseed oil, mineral oil, glycerides, polyglycol esters, butyl stearate, octyl stearate, esters of oleic acid, trimethylolpropane/caprylic acid esters, 2-methyl-2-propylpropane-1,3-dioldilaurate, a polysiloxane, a polyethylene oxide polypropylene oxide adduct or mixtures thereof.

12. The method of claim 1 wherein said emulsifier is a fatty acid salt, a higher fatty alcohol, a sorbital ester or sorbitan, a phosphate ester, a sulfonated aromatic petroleum hydrocarbon, a sulfonated naphthenate, a sulfonated vegetable oil, a polyoxyethylene ester or ether, a polyglycerol ester, a glycerol mono-di-fatty acid ester or mixtures thereof.

13. The method of claim 1 wherein said associative thickener causes less than a 20 cps increase in the initial viscosity of said spin finish.

14. The method of claim 13 wherein said associative thickener causes less than a 10 cps increase in the initial viscosity of said spin finish.

15. The method of claim 1 wherein the viscosity of said composition increases by at least about 100 cps as the water content decreases to between about 70 and about 90% by weight.

16. The method of claim 15 wherein the viscosity of said composition increases by at least about 150 cps as the water content decreases to between about 70 and about 90% by weight.

17. The method of claim 1 wherein the initial viscosity of said composition is below about 100 cps.

18. The method of claim 17 wherein the initial viscosity of said composition is below about 20 cps.

19. The method of claim 17 wherein said oil-based component has a viscosity less than about 60 cps.

* * * * *

UNITED STATES PATENT OFFICE

CERTIFICATE OF CORRECTION

Patent No. 4,859,350 Dated August 22, 1989

Inventor(s) Gunilla E. Gillberg-LaForce et al

It is certified that error appears in the above-identified patent and that said Letters Patent is hereby corrected as shown below:

Title page:

Line [75], change Applicant from "Gunilla E. Gillberg-LaFore" to --Gunilla E. Gillberg-LaForce--;

In the Abstract, lines 13-14, change "evnironment" to --environment--;

In the Abstract, line 15, change "substsantially" to --substantially--.

Signed and Sealed this

Tenth Day of July, 1990

*Attest:*

HARRY F. MANBECK, JR.

*Attesting Officer*

*Commissioner of Patents and Trademarks*